US008740499B2

(12) United States Patent
Heavenor

(10) Patent No.: US 8,740,499 B2
(45) Date of Patent: Jun. 3, 2014

(54) PASSIVE OCEAN CURRENT DEFLECTOR

(76) Inventor: Michael Wayne Heavenor, British Columbia (CA)

( * ) Notice: Subject to any disclaimer, the term of this patent is extended or adjusted under 35 U.S.C. 154(b) by 336 days.

(21) Appl. No.: 12/919,207

(22) PCT Filed: Feb. 24, 2009

(86) PCT No.: PCT/CA2009/000209

§ 371 (c)(1),
(2), (4) Date: Aug. 24, 2010

(87) PCT Pub. No.: WO2009/105867

PCT Pub. Date: Sep. 3, 2009

(65) Prior Publication Data

US 2011/0033240 A1 Feb. 10, 2011

Related U.S. Application Data

(60) Provisional application No. 61/064,322, filed on Feb. 28, 2008.

(51) Int. Cl.
*E02B 3/02* (2006.01)

(52) U.S. Cl.
USPC ..... 405/80; 210/170.01

(58) Field of Classification Search
USPC ..... 405/80; 210/145.7, 170.09, 170.11, 210/170, 170.111
See application file for complete search history.

(56) References Cited

U.S. PATENT DOCUMENTS

| | | | | | |
|---|---|---|---|---|---|
| 3,704,008 | A | * | 11/1972 | Ziegler | 261/25 |
| 4,189,379 | A | * | 2/1980 | Finley | 210/644 |
| 4,294,564 | A | * | 10/1981 | Person et al. | 405/224.2 |
| 4,439,060 | A | * | 3/1984 | Liscio | 405/61 |
| 4,628,906 | A | | 12/1986 | Tonoli | |

FOREIGN PATENT DOCUMENTS

| | | | |
|---|---|---|---|
| JP | 2001/323430 | A | 11/2001 |
| JP | 2007/189972 | A | 8/2007 |
| JP | 2007/308884 | A | 11/2007 |
| WO | WO 2009/105867 | A1 | 9/2009 |

OTHER PUBLICATIONS

Liang, "Concept Design of Artificial Upwelling Induced by Natural Forces," Institute of Oceanography, National Taiwan University; pp. 391-393; 1991.

International Search Report dated Jun. 29, 2009, issued in corresponding International Patent Application No. PCT/CA2009/000209, filed Feb. 24, 2009.

* cited by examiner

*Primary Examiner* — Benjamin Fiorello
(74) *Attorney, Agent, or Firm* — Klarquist Sparkman, LLP

(57) ABSTRACT

A passive ocean current deflector has an elongated conduit positionable in an ocean with its lower inlet end below the euphotic zone and anchored in place and its upper outlet end positioned in the euphotic zone and retained in place. Ocean currents direct cooler, nutrient rich ocean water into the inlet end and upwardly through the conduit to exit out the outlet end to intermix with water in the euphotic zone.

27 Claims, 8 Drawing Sheets

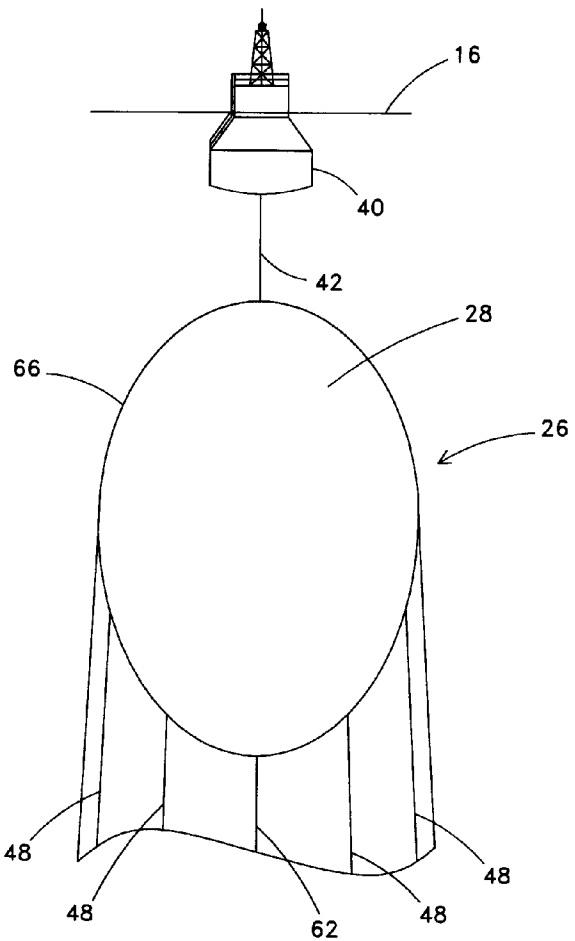
FIG. 4-B
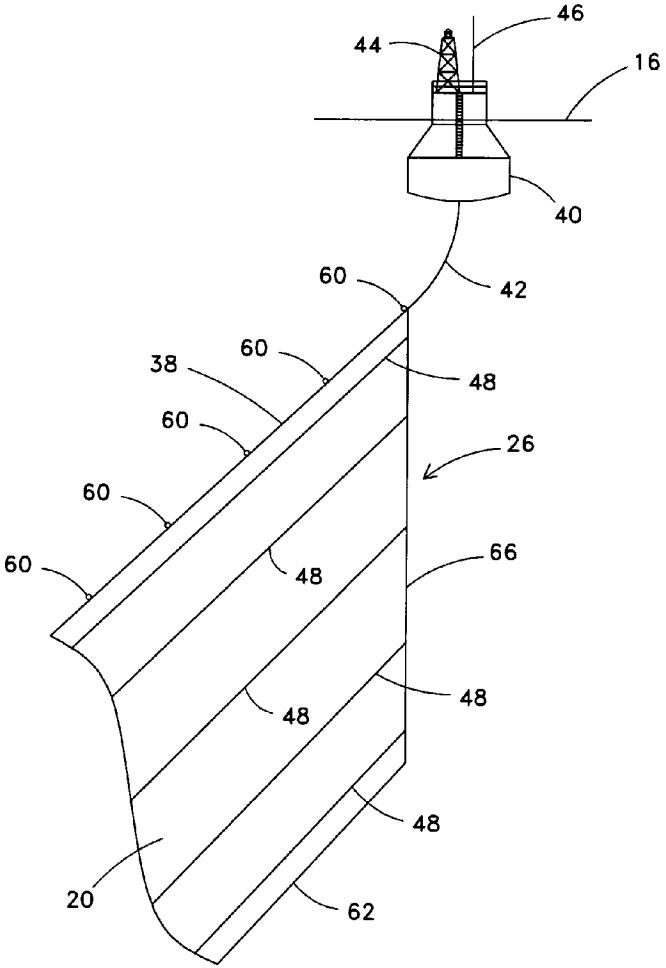
FIG. 4-A

PASSIVE OCEAN CURRENT DEFLECTOR

CROSS REFERENCE TO RELATED APPLICATIONS

This is the U.S. National Stage of International Application No. PCT/CA2009/000209, filed Feb. 24, 2009, which was published in English under PCT Article 21(2), which in turn claims the benefit under 35 U.S.C. §119(e) to U.S. provisional application No. 61/064,322 filed Feb. 28, 2008. Both applications are incorporated herein in their entirety

BACKGROUND OF THE INVENTION

This invention relates to a method and apparatus for raising lower cooler nutrient rich ocean water to mix with warmer nutrient poor ocean water to facilitate cooling of upper ocean water and phytoplankton growth.

It has long been known that deep waters of the earth's oceans are rich in nutrients. These include nitrate and phosphate, the result of decomposition of sinking organic matter (dead/detrital plankton) from surface waters. These deep water nutrients are located below the zone where sunlight can reach (below the "euphotic zone") and photosynthesis cannot take place. As a consequence, these nutrients are normally unavailable to sea life which utilizes photosynthesis to thrive. The euphotic zone is that upper layer of water within which there is sufficient sunlight to support sea life processes. The sub-euphotic zone is the zone below the euphotic zone within which there is contained the nutrient substances, both organic and inorganic, for the growth and flourishing of sea life. When brought to the euphotic zone, these nutrients are utilized by phytoplankton, along with dissolved CO2 (carbon dioxide) and light energy from the sun, to produce organic compounds, through the process of photosynthesis.

Up-welling is an oceanographic phenomenon that involves upward motion of dense, cooler, and usually nutrient-rich water towards the ocean surface, replacing the warmer, usually nutrient-depleted surface water. The up-welling waters are usually rich in the dissolved nutrients (e.g., nitrogen and phosphate compounds) required for phytoplankton growth. This nutrient transport into the surface waters where sunlight is present (in the euphotic zone) is also required for phytoplankton growth. The combination of nutrient rich water from the depths and sunlight in the euphotic zone results in rapid growth of phytoplankton populations. Phytoplankton forms the base of marine food webs (or food chains).

Most up-welling areas are closely related to human fishing activities as natural up-welling supports some of the most productive fisheries in the world, including small species such as sardines, anchovies, etc. Natural up-welling regions therefore result in very high levels of primary production (the amount of carbon fixed by phytoplankton) in comparison to other areas of the ocean. High primary production propagates up the food chain because phytoplankton are at the base of the oceanic food chain. Up-welling fuels algae and shrimp like krill populations that feed small fish, which provide an important food source for a variety of sea life, from salmon to sea birds and marine mammals. And without up-welling, high-fat plankton such as krill stay at lower depths. The world's most productive fisheries are located in areas of coastal up-welling that bring cold nutrient rich waters to the surface (especially in the eastern boundary regions of the subtropics). About half the world's total fish catch comes from up-welling zones.

The food chain follows the course of:

Phytoplankton-->Zooplankton-->Predatory zooplankton-->Filter feeders-->Predatory fish Ocean water up-welling occurs naturally. For example, in some coastal areas of the ocean (and large lakes such as the North American Great Lakes), the combination of persistent winds, Earth's rotation (the Coriolis effect), and restrictions on lateral movements of water caused by shorelines and shallow bottoms induces upward and downward water movements. The Coriolis effect plus the frictional coupling of wind and water (Ekman transport) cause net movement of surface water at about 90 degrees to the right of the wind direction in the Northern Hemisphere and to the left of the wind direction in the Southern Hemisphere. Coastal up-welling occurs where Ekman transport moves surface waters away from the coast; surface waters are replaced by water that wells up from below.

Up-welling is most common along the west coast of continents (eastern sides of ocean basins). In the Northern Hemisphere, up-welling occurs along west coasts (e.g., coasts of California, Northwest Africa) when winds blow from the north (causing Ekman transport of surface water away from the shore). Winds blowing from the south cause up-welling along continents' eastern coasts in the Northern Hemisphere, although it is not as noticeable because of the western boundary currents. Up-welling also occurs along the west coasts in the Southern Hemisphere (e.g., coasts of Chile, Peru, and southwest Africa) when the wind direction is from the south because the net transport of surface water is westward away from the shoreline. Winds blowing from the north cause up-welling along the continents' eastern coasts in the Southern Hemisphere. Regions of natural up-welling include coastal Peru, Chile, Arabian Sea, western South Africa, eastern New Zealand, southeastern Brazil and the California coast.

Up-welling (and down-welling) also occur in the open ocean where winds cause surface waters to diverge from a region (causing up-welling) or to converge toward some region (causing down-welling). For example, up-welling takes place along much of the equator. The deflection due to the Coriolis effect reverses direction on either side of the equator. Hence, westward-flowing, wind-driven surface currents near the equator turn northward on the north side of the equator and southward on the south side. Surface waters are moved away from the equator and replaced by up-welling waters.

Up-welling of ocean water also influences sea-surface temperature. Up-welling waters which originate below the euphotic zone are colder than the surface waters they replace. Coastal up-welling and down-welling also influence weather and climate. Along the northern and central California coast, up-welling lowers sea surface temperatures and increases the frequency of summer fogs. Relatively cold surface waters chill the overlying humid marine air to saturation so that thick fog develops. Up-welling cold water inhibits formation of tropical cyclones (e.g., hurricanes), because tropical cyclones derive their energy from warm surface waters. During El Niño and La Niña, changes in sea-surface temperature patterns associated with warm and cold-water up-welling off the northwest coast of South America and along the equator in the tropical Pacific affect the inter-annual distribution of precipitation around the globe.

Scientists suspect that rising ocean temperatures and dwindling plankton populations are behind a growing number of seabird deaths, reports of fewer salmon and other anomalies along the West Coast. Coastal ocean temperatures are 2 to 5 degrees above normal, which is believed to be caused by a lack of natural up-welling.

Apart from their role in food productivity up the food chain, scientists also understand the role of the ocean's plants in removing carbon from the atmosphere. Tiny ocean plants that grow at the ocean's surface—phytoplankton—soak up more carbon dioxide than anything else on Earth, including dense tropical forests. Since ocean plants remove so much of the greenhouse gas from the atmosphere, they play an important role in mitigating global warming.

However, the normal tides, wind forces and currents are surface oriented and move horizontally or circumferentially over the earth, with but few geological inducements to create vertical currents that transfer waters from the depths. Natural up-welling has only a limited effect in displacement of the euphotic region waters with sub euphotic water, and vertical up-welling mass movement of waters as a result of natural effects is limited.

In light of the foregoing advantages resulting from the up-welling of sea water, and the limited effect of natural up-welling, there is a need for a method and apparatus which passively raises sea water and associated nutrients from ocean depths below the euphotic zone into the euphotic zone.

SUMMARY OF THE INVENTION

In an embodiment of the invention a method for utilising the current in a large body of water, including an ocean to raise water from a lower region of the body of water, containing colder more nutrient rich water, to an upper region of the body of water, containing warmer less nutrient rich water is provided, comprising the steps of:

(a) submersing a conduit into the body of water, the conduit including a lower end having a lower opening and an upper end having an upper opening, such that the lower opening is in the lower region and the upper opening is in the upper region;

(b) anchoring the lower opening in place against movement by the current;

(c) maintaining the upper opening downstream from the lower opening so that the conduit is angled from the vertical in a direction downstream from the lower opening wherein the conduit defines a plane oriented parallel with the current and the lower opening defines a plane oriented perpendicular with the current;

(d) utilising the current to direct the water into the lower opening to flow upwards through the conduit and out the upper opening.

As an alternative the maintaining at step (c) above may be undertaken by utilising the current to maintain the upper opening in the position described in step (c).

As a further alternative, prior to step (a) above:

(a) selecting a location of the body of water where the current at an upper region at the selected location is greater than the current at the lower region of the selected location;

(b) determining the distance between the upper region and the lower region;

(c) selecting a conduit of appropriate length such that when submersed in accordance with steps (a), (b) and (c) above, the lower end is at or near the lower region at the selected location and the upper end is at or near the upper region at the selected location.

As a further alternative the selected location is selected based on their being sufficient difference in current at the upper region as compared to the lower region to facilitate the flow of water in the conduit from the lower opening to, and out of, the upper opening.

In an alternate embodiment of the invention a passive current deflector for raising water and embedded nutrients from a lower region of a large body of water, including an ocean, having a current, the deflector comprising:

(a) a conduit suitable for submersing into the body of water, the conduit including a lower end having a lower opening and an upper end having an upper opening;

(b) an anchor connected to the lower end for maintaining the lower opening in place against movement by the current;

(c) means for maintaining the upper opening downstream from the lower opening so that in use the conduit is angled from the vertical in a direction downstream from the lower opening and wherein the conduit defines a plane aligned with the current so that the lower opening is aligned with the current;

wherein, due to the position of the conduit in use, the current directs water into the lower opening causing it to flow upwards through the conduit and out the upper opening.

The deflector can include vanes extending outwardly form the lower opening responsive to the current flow to urge the periphery of the opening outwardly to maintain the shape of the opening.

DESCRIPTION OF THE DRAWINGS

FIG. 4A is a close up side view of the upper opening of the passive ocean current deflector of FIG. 1;

FIG. 4B is a close up lateral view looking into the upper opening of the passive ocean current deflector of FIG. 1;

DETAILED DESCRIPTION OF PREFERRED EMBODIMENTS

Figure 1:
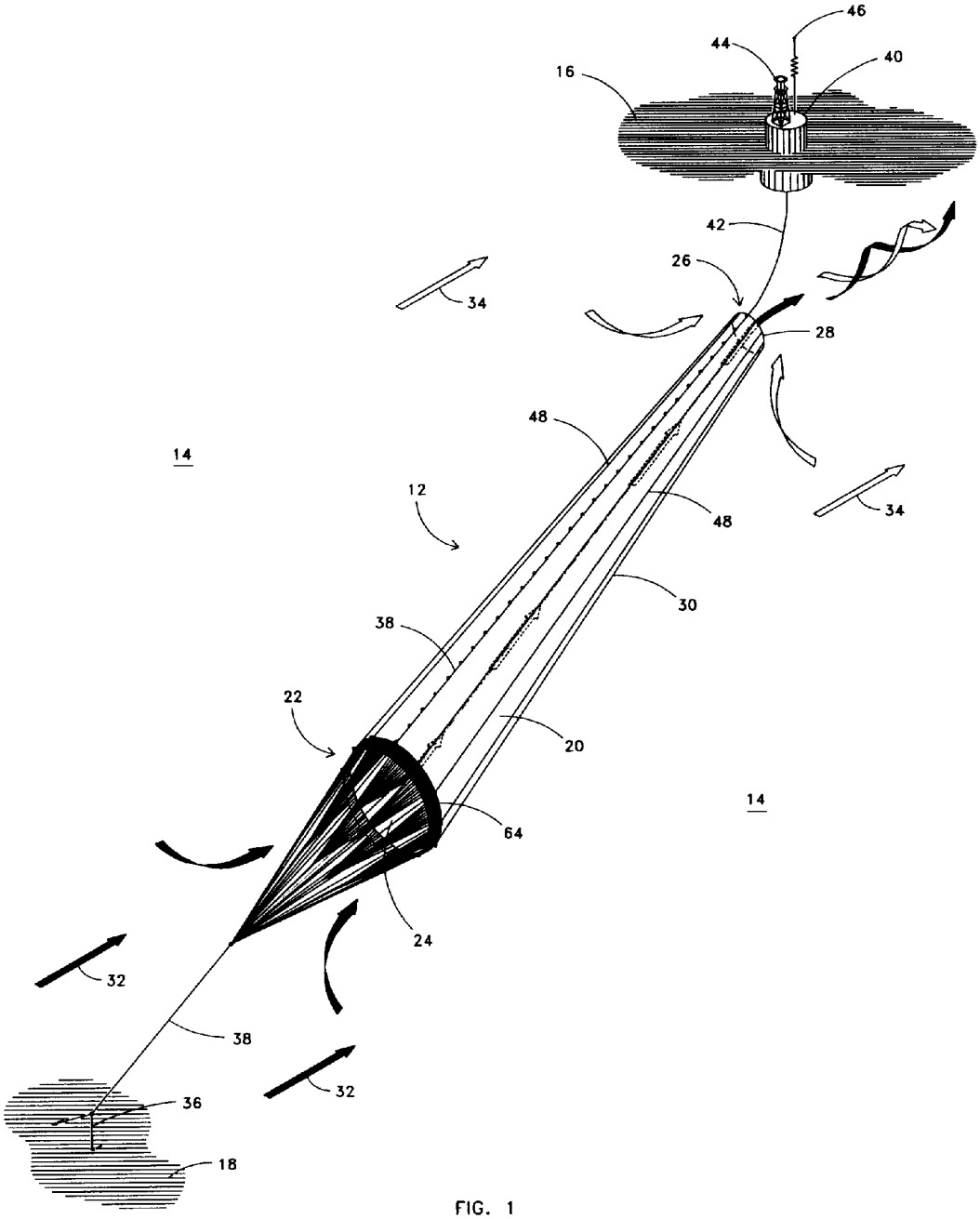
FIG. 1 is a perspective view of the passive ocean current deflector of an embodiment of the present invention.
Figure 2:
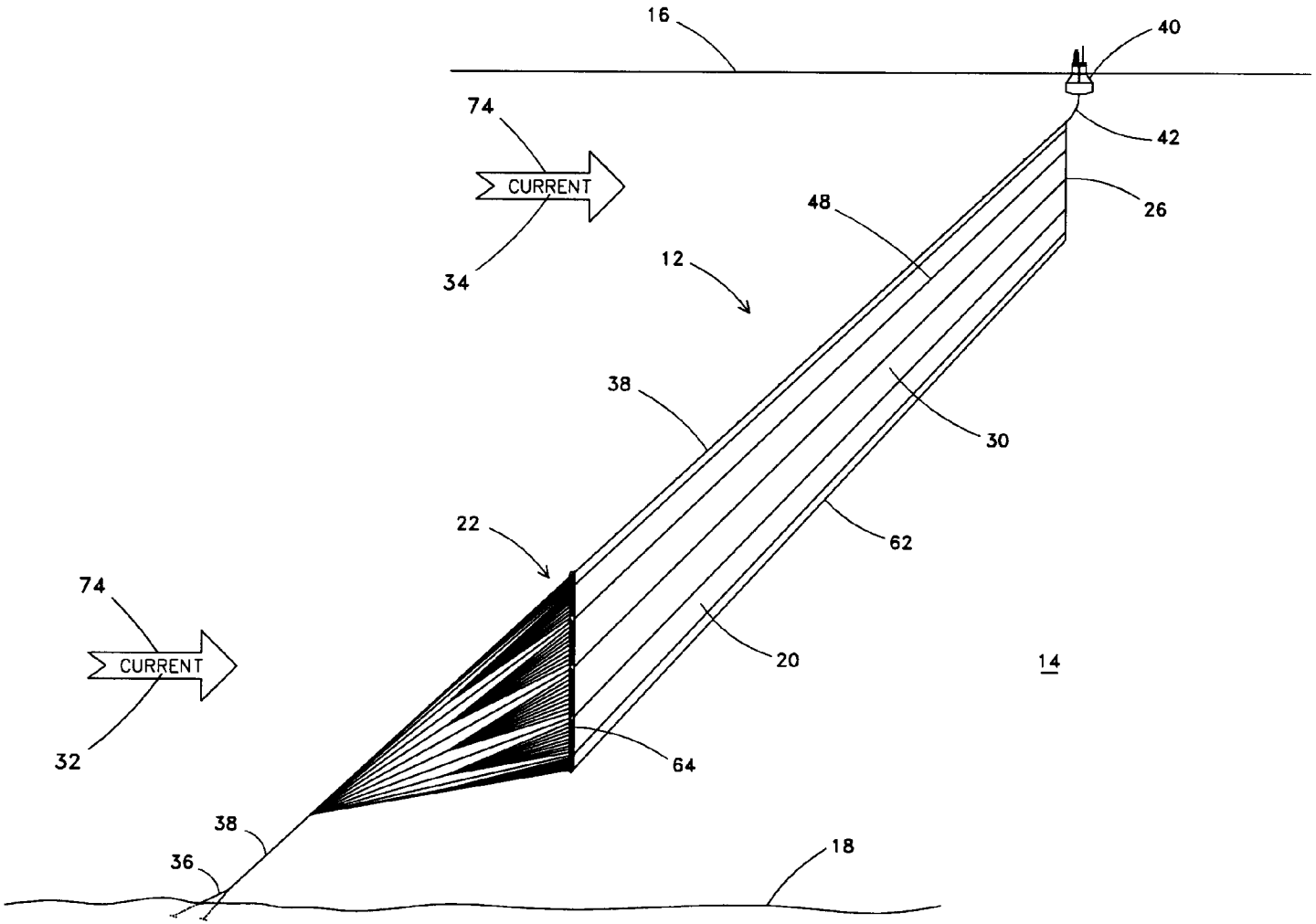
FIG. 2 is a side plan view of the passive ocean current deflector of FIG. 1.

Referring initially to FIGS. 1 and 2, passive current deflector 12 for raising water and embedded nutrients from a lower region of a large body of water, including an ocean, having a current, is shown. Deflector 12 is submerged in a suitable location in ocean 14 positioned between the ocean surface 16 and the ocean seabed 18.

Deflector 12 includes a longitudinal body 20 having lower end 22 with a lower opening 24 at one end and an upper end 26 and upper opening 28 at its upper end. Body 20 forms a conduit 30 through which ocean water may pass. Body 20 is also tapered with a larger cross-sectional area adjacent end 22 tapering to a smaller cross-sectional area as one moves toward upper end 26. Thereby, conduit 30 is larger at lower end 22 as compared to upper end 26.

Preferably body 20 is made from an impervious synthetic woven fabric of at least 420 denier. Also further preferably lower end 22 is elliptical in shape with a horizontal diameter of about 50 meters and a vertical diameter of about 70 meters. It is also preferred that the upper opening 26 be circular with a diameter of about 30 meters. Alternatively, the cross-sectional area of lower opening 22 is preferably between 1.5 to 2 times as large as the cross-sectional area of upper opening 26.

As seen best in FIG. 2, openings 22 and 26 define respective planes at about a 45 degree angle in relation to the sides of body 20.

Anchor 36 is secured to the ocean seabed 18 in a manner which prevents movement of anchor 36 in relation to seabed 18. Anchor line 38 connects anchor 36 to body 20, described in more detail below. Anchor 36 may consist of two 1000 kg spade type anchors separated by a ten meter length of 1¼ inch open link iron chain. Another ten meter length of chain will attach the down stream anchor to the anchor line. The connections between anchors and chain is by 1½ inch rated shackles. The anchor line 38 is made of synthetic fibre rope. It will be attached to the anchor chain by soft splice. Some options are Super Dan-line, Polysteel, and Sea Steel. They will be three strand and have a diameter of between 2 and 2½ inches. Anchor line 38 is continuous to an attachment point adjacent upper end 26 where it is attached to a one inch stainless steel wire cable of 10 meters in length, identified as the buoy line 42, that attaches to the compensator buoy 40.

Compensator buoy 40 floats on ocean surface 16. Buoy 40 is connected to body 20 by means of buoy line 42. Buoy 40 includes a solar powered lamp combination 44 to warn shipping of the location of a deflector 2 when submerged in ocean 14. GPS transponder 46 is also positioned on buoy 40 to ensure that the location of deflector 12 in ocean 14 can be determined at all times by satellite. Buoy 40 is made of ¼ inch mild steel plate, sandblasted and painted. It has a displacement sufficient to maintain upper opening 28 close to surface 16.

Preferably, deflector 12 is positioned in ocean 14 at an ocean location wherein lower ocean current 32 is less than upper ocean current 34. For example, deflector 12 may be placed where lower ocean current 32 is about two knots and upper ocean current 34 is about four knots. As best seen in FIG. 2, because anchor 36 is fixed in place on seabed 18 and buoy 40 is free to move with ocean current 34, deflector 12 is forced into an angled position, angled from the vertical by about 45 degrees, in the embodiment depicted in FIGS. 1 and 2. When angled in that manner, lower end 22 and lower opening 24 define a plane which is generally vertical in orientation. Similarly, when deflector 12 is so oriented in ocean 14, upper end 26 and upper opening 28 form a plane which is also generally vertical in orientation.

Body 20 includes several rib lines 48 generally at every 30 degrees of arc about body 20. Rib lines 48 extend from lower end 22 to upper end 26 and are continually attached to the conduit 30.

Figure 3:
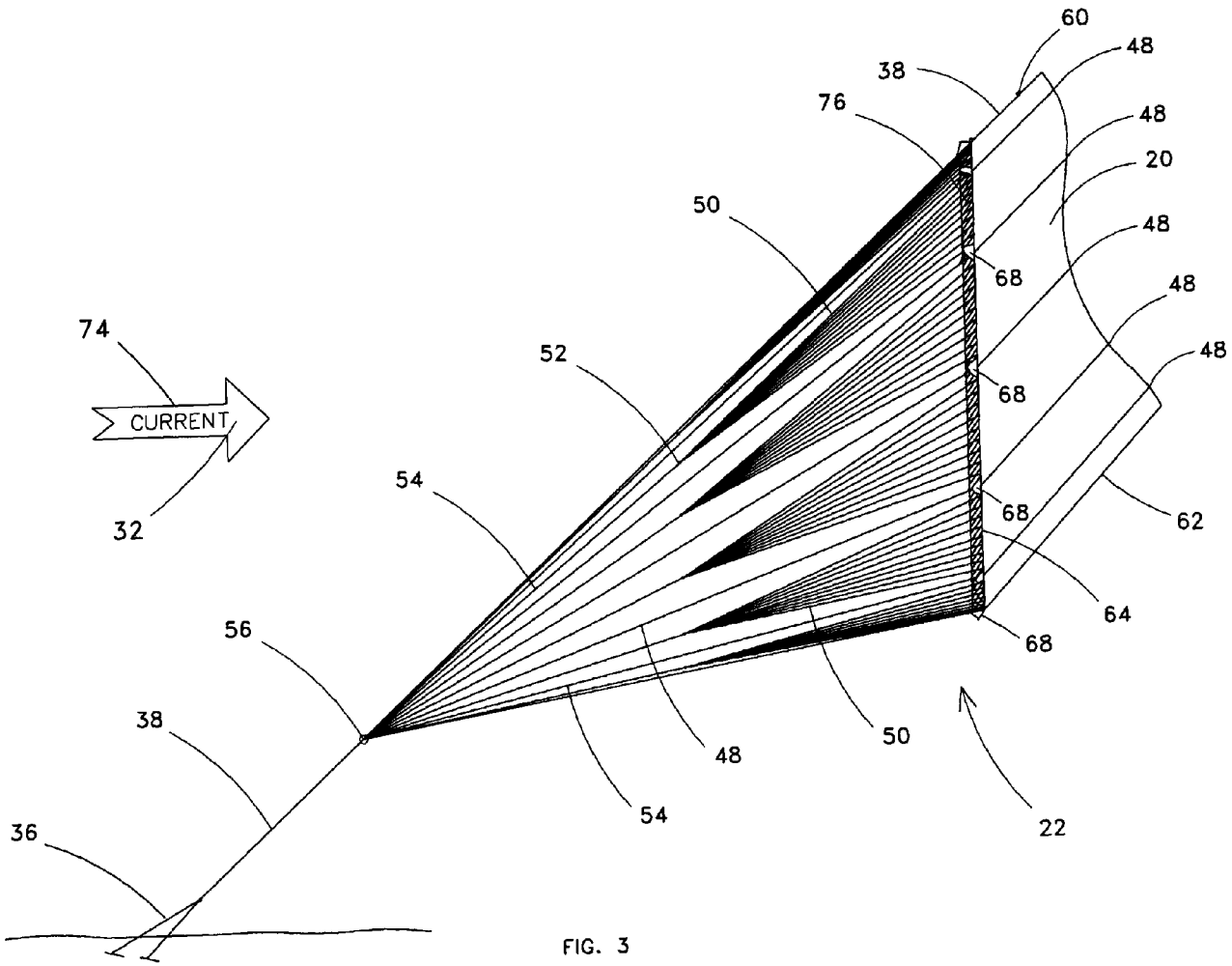
FIG. 3 is a close up side view of the lower opening of the passive ocean current deflector of FIG. 1.
Figure 5:
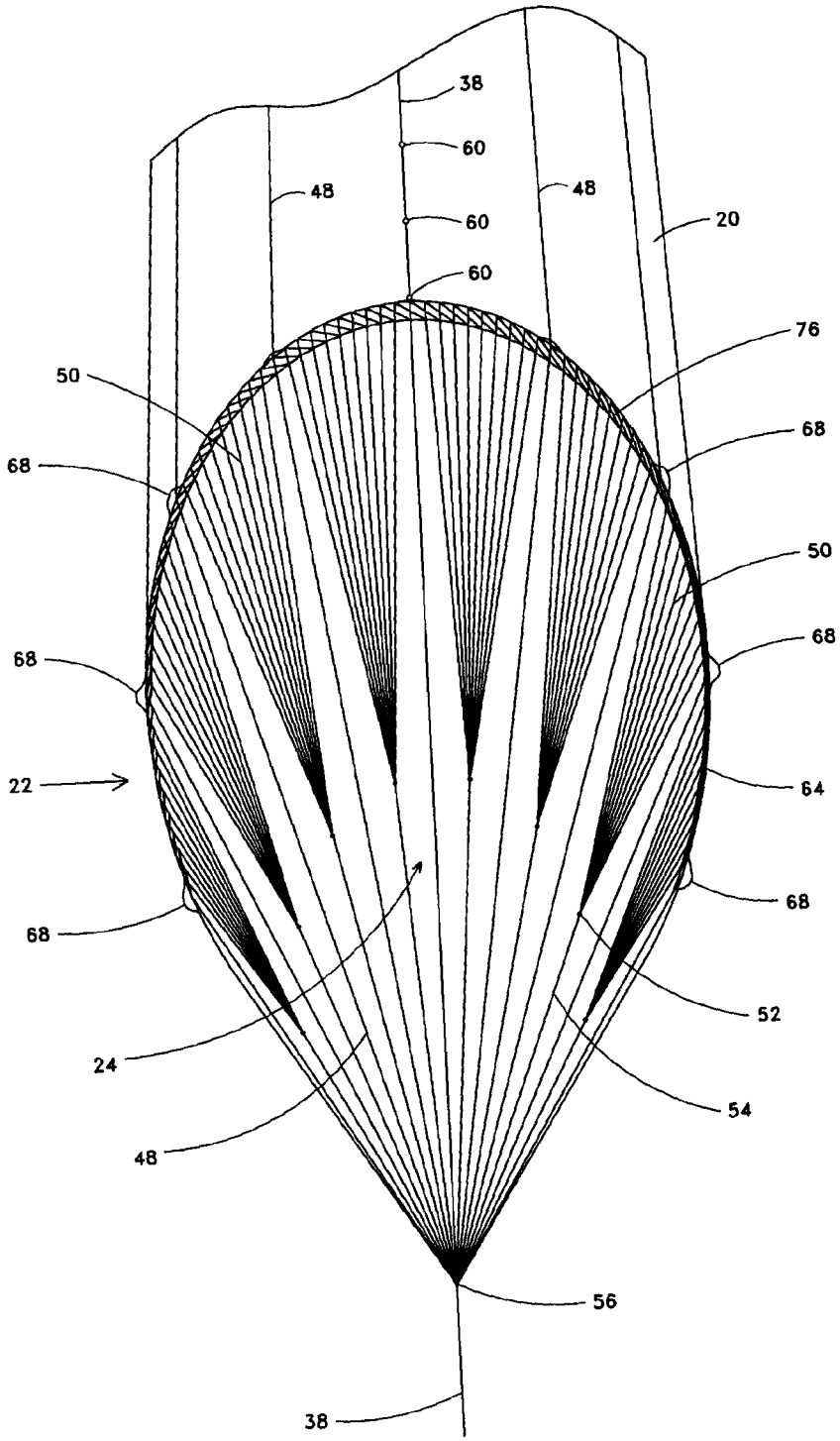
FIG. 5 is a close up lateral view looking into the lower opening of the passive ocean current deflector of FIG. 1.

As seen best in FIGS. 3 and 5, a plurality of minute lines 50 are positioned about opening 24 along lower end 22 in groups of nine converging to apex 52. Apex 52 is attached to convergence line 54 which converge at anchor apex 56. Each minute line 50 is positioned about opening 24 at approximately every three degrees of arc. Between each rib line 48, at every approximately three degrees of arc, a minute line 50 is attached to the frame line. They converge to a single point about half way from the body 20 to the point of intersection on anchor line 38 where the rib lines 48 are connected. A single line connecting nine minute lines 50 (each at approximately three degrees of arc) runs from the connection to the point of intersection of the rib lines 48, referred to as the convergence line 54. These lines are connected to the anchor line 38 along with the rib lines 48 at apex 56. Minute lines 50 are of ¼ inch diameter, synthetic fibre rope.

Anchor line 38 is attached along the entire length of conduit 30. It forms a continuous line from anchor 36 at its lower end to the lower end of buoy line 42 at its upper end, thereby supporting the body 20. Deep Trawl Floats 60 are attached to the anchor line 38 about every 10 meters to maintain body 20 in an upright position, with anchor line 38 at the top of body 20.

Body 20 further includes lead line 62 positioned opposite to anchor line 38. Lead line 62 is weighted sufficiently to almost neutralize the buoyancy force of floats 60 thereby stabilizing body 20 when submerged and maintaining lead line 62 separate from anchor line 38 thereby maintaining conduit 30 within body 20 in the upright position.

Lower end 22 also includes circumferential frame 64 of generally more rigid material as compared to body 20. Frame 64 may be formed by folding back material from body 20 thereby doubling that material to form a more rigid frame 64. Minute lines 50 are all attached to frame 64 about the circumference of opening 24.

Referring to FIGS. 4A and 4B, upper end 26 is depicted with opening 28. Anchor line 38 is shown connected at 10 meter intervals continuously along body 20. Lead line 62 is positioned on the opposite side of body 20 from anchor line 38. Opening 28 is surrounded by upper circumferential frame 66 to which lines 38, 48 and 62 are attached. Frame 66 generally maintains opening 28 in a circular or elliptical orientation assisted by the buoyancy of floats 60 acting on anchor line 38 and the weight of lead line 62 acting against that buoyancy. This is further assisted by the pressure differential between the inside of conduit 30 and the outer ocean 14.

Referring initially to FIGS. 3 and 5, a plurality of paravanes 68 are positioned about the circumference of frame 64.

Figure 6:
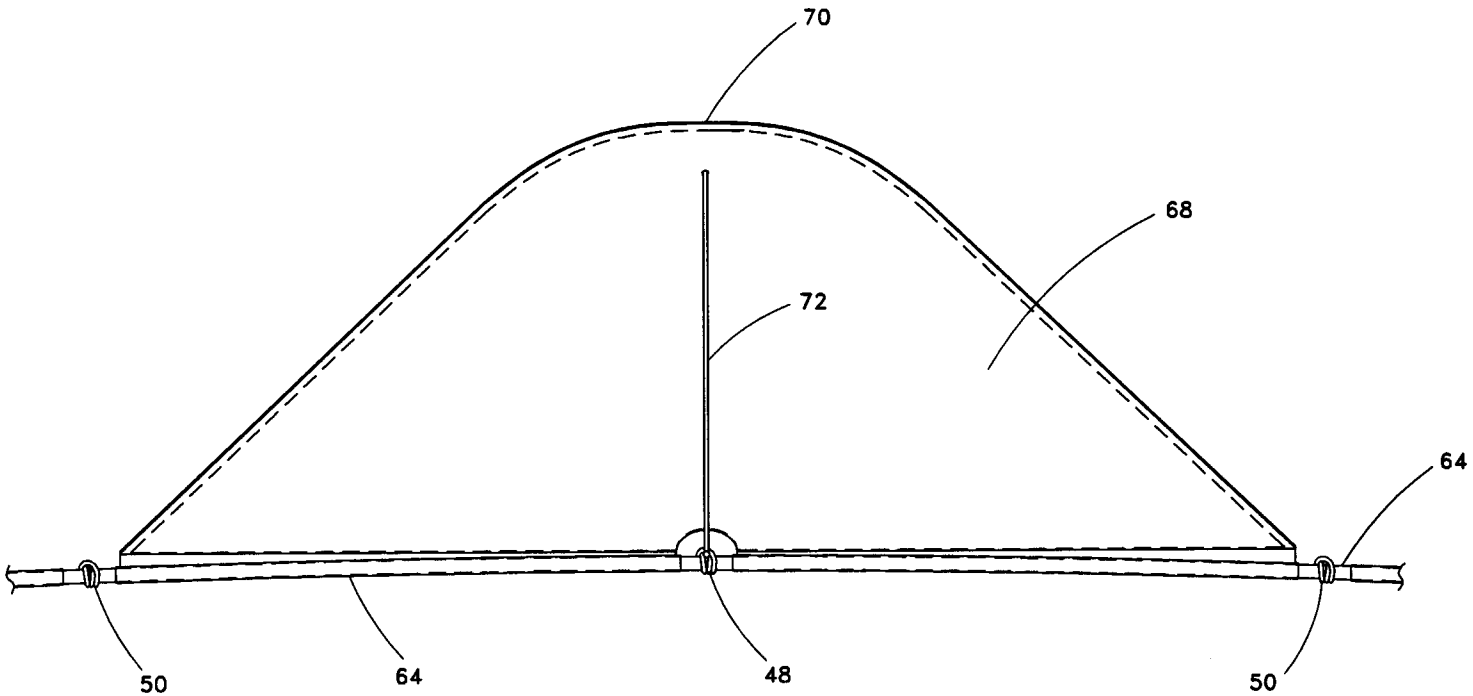
FIG. 6 is a close up side inside view of a paravane of the lower opening of FIG. 5.
Figure 7:
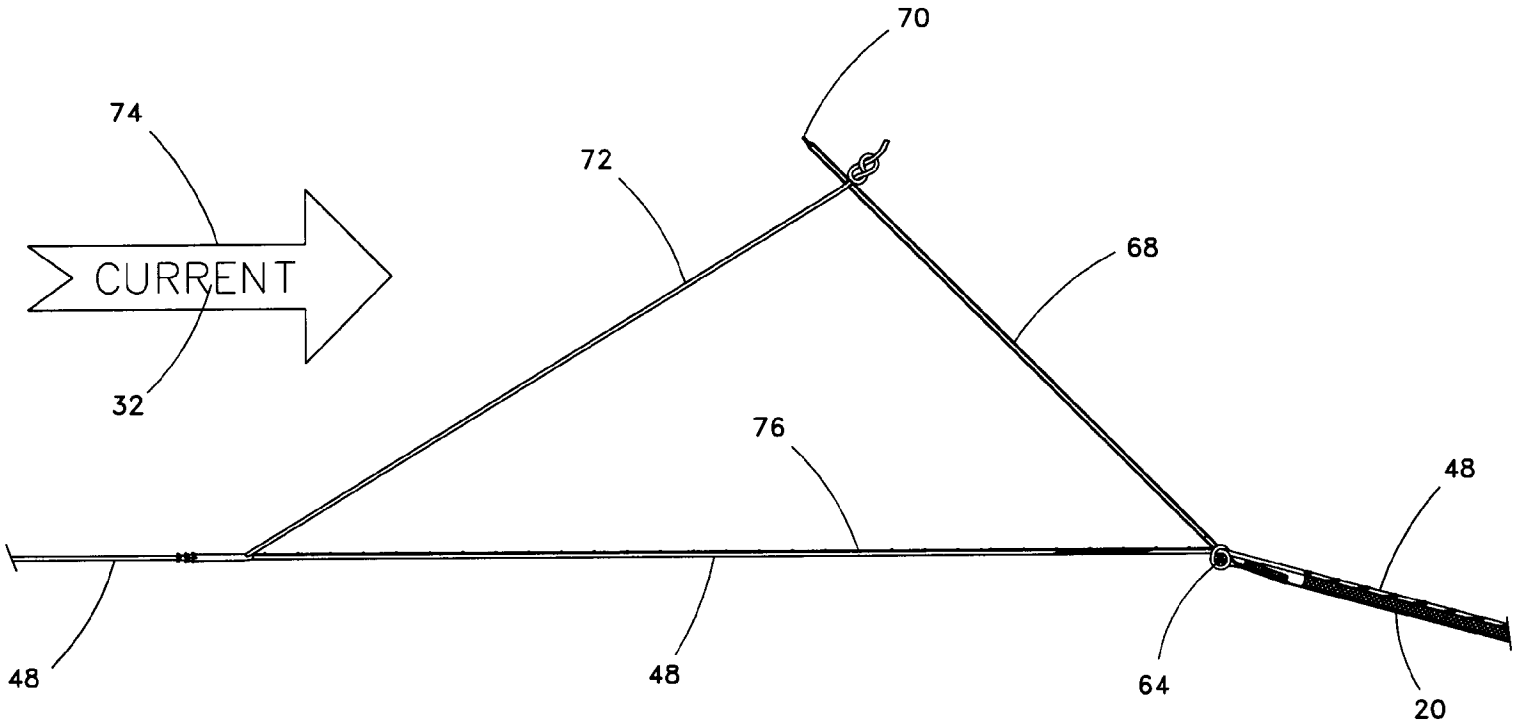
FIG. 7 is a close up side outside view of the paravane of the lower opening of FIG. 5.
Figure 8:
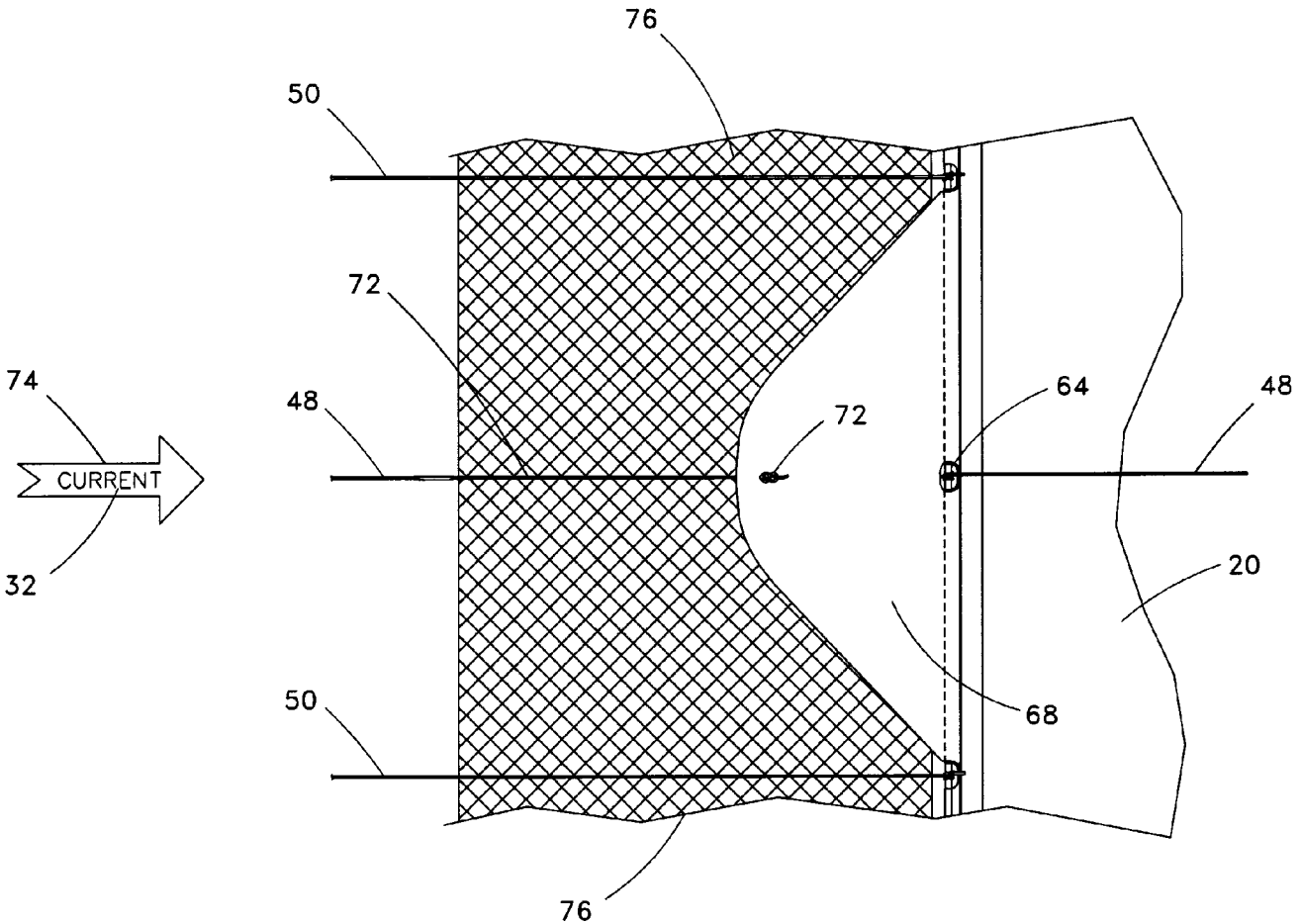
FIG. 8 is a close up top view of the paravane of the lower opening of FIG. 5.

FIGS. 6, 7 and 8 depict close-up views of one paravane 68. Paravane 68 are pivotally attached to frame 64. Paravane 68 are generally straight and follow the contour of frame 64 at the inner end. Outer periphery of paravane 68 is generally curved with an apex 70.

Paravane line 72 is connected to paravane 68 adjacent apex 70 at one end and to a rib line 48 at the other end. Paravane line 72 generally maintains paravane 68 in an angled orientation extending outwardly from frame 64 and also angled generally toward anchor 36 in relation to the plane defined by frame 64. Ocean current flow 32 pushes against paravane 68 which maintains paravane 68 in that angled position held in place by paravane lines 72. Thereby ocean currents flowing in the direction of arrow 74 provide a current force against each paravane 68 of the plurality about frame 64 thereby maintaining opening 24 in a generally elliptical orientation as depicted in FIG. 5.

As depicted in FIG. 8, preventor web 76 is attached to minute lines 50, rib lines 48 and circumferential frame 64. Preventor web 76 consists of interlocking and crossed lines forming a plurality of openings, similar in orientation as with a fishing web. Preventor web 76 prevents fouling of paravanes 68 with lines 48 and 50.

When in use deflector 12 is placed in ocean 14 in the manner depicted in FIGS. 1 and 2. Anchored to the seabed 18 by anchor 36 at a lower end, which is positioned below the euphotic zone, and attached to a free-floating buoy at the other. Ocean currents 34 near the upper end 26 push buoy in a downstream direction to orient deflector 12 at an angle that is preferably about 45 degree. Ocean water driven by lower ocean currents 32 are forced into opening 24 to travel upwardly through conduit 30 and out upper opening 26 into the upper ocean water which is in the euphotic zone. Cooler water rich in nutrients is thereby brought into the euphotic zone where sunlight is available to permit photosynthesis by sea life which feeds on those nutrients.

While this invention has been described as a having a preferred embodiment, it is understood that it is capable of further modifications, uses and/or adaptations of the invention following in general the principle of the invention and including such departures from the present disclosure has come within the known or customary practice in the art to which the invention pertains and as may be applied to the central features herein before set forth, and fall within the scope of the invention and of the limits of the appended claims. As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative or exemplary only and not restrictive. The scope of the present invention is as set forth in the complete disclosure rather than being limited to the examples set forth in the foregoing description.

The invention claimed is:

1. A method for utilising the current in a large body of water, including an ocean to raise water from a lower region of the body of water, containing colder more nutrient rich water, to an upper region of the body of water, containing warmer less nutrient rich water, comprising the steps of:

(a) submersing a conduit into the body of water, the conduit including a lower end having a lower opening and an upper end having an upper opening, such that the lower opening is in the lower region and the upper opening is in the upper region;

(b) anchoring the lower opening in place against movement by the current;

(c) maintaining the upper opening downstream from the lower opening so that the conduit is angled from the vertical in a direction downstream from the lower opening wherein the conduit is oriented in a direction with the current and the lower opening is oriented in a generally vertical plane wherein the maintaining is undertaken by utilising the current to maintain the upper opening downstream of the lower opening;

(d) utilizing the current to direct the water into the lower opening to flow upwards through the conduit and out the upper opening; and wherein the cross-sectional area of the lower opening is greater than the cross-sectional area of the upper opening.

2. The method as described in claim 1 further comprising, prior to step (a) of claim 1:

(a) selecting a location of the body of water where the current at an upper region at the selected location is greater than the current at the lower region of the selected location;

(b) determining the distance between the upper region and the lower region;

(c) selecting a conduit of appropriate length such that when submersed in accordance with steps (a), (b) and (c) of claim 1, the lower end is at or near the lower region at the selected location and the upper end is at or near the upper region at the selected location.

3. The method as described in claim 2 wherein the selected location is selected based on their being sufficient difference in current at the upper region as compared to the lower region to facilitate the flow of water in the conduit from the lower opening to, and out of, the upper opening.

4. The method as described in claim 1 wherein the cross-sectional area of the lower opening is between 1.5 to 2 times as large as the cross-sectional area of the upper opening.

5. The method as described in claim 4 wherein the lower opening is elliptical with a horizontal diameter of about 50 meters and a vertical diameter of about 70 meters and the upper opening is circular with a diameter of about 30 meters.

6. The method as described in claim 1 wherein after step (b) of claim 1:

(a) connecting the upper opening to a float responsive to the current at the upper region of the body of water to cause the upper opening to be oriented downstream of the lower opening.

7. The method as described in claim 6 wherein a cable further acts to support the conduit throughout the length of the conduit.

8. The method as described in claim 7 wherein the conduit comprises a plurality of retainers each connected to a section of the cable to support the conduit along its length.

9. The method as described in claim 1 further comprising, after step (d) of claim 1:

(a) decreasing the water temperature at the upper opening by reason of the directing of water at step (d) of claim 1.

10. The method as described in claim 1 further comprising, after step (d) of claim 1:

(a) causing nutrients located at the lower region to be raised with the directing of water in the conduit at step (d) of claim 1, to the upper region.

11. The method as described in claim 1 wherein the outer periphery of the lower opening defines a plane that is substantially vertical when the upper opening is maintained in the said position downstream from the lower opening.

12. A method for utilising the current in a large body of water, including an ocean to raise water from a lower region of the body of water, containing colder more nutrient rich water, to an upper region of the body of water, containing warmer less nutrient rich water, comprising the steps of:

(a) submersing a conduit into the body of water, the conduit including a lower end having a lower opening and an upper end having an upper opening, such that the lower opening is in the lower region and the upper opening is in the upper region;

(b) anchoring the lower opening in place against movement by the current;

(c) maintaining the upper opening downstream from the lower opening so that the conduit is angled from the vertical in a direction downstream from the lower opening wherein the conduit is oriented in a direction with the current and the lower opening defines a plane oriented generally perpendicular with the current wherein the maintaining is undertaken by utilizing the current to maintain the upper opening downstream of the lower opening;

(d) utilizing the current to direct the water into the lower opening to flow upwards through the conduit and out the upper opening;

wherein after step (b): connecting the upper opening to a float responsive to the current at the upper region of the body of water to cause the upper opening to be oriented downstream of the lower opening;

wherein a cable further acts to support the conduit throughout the length of the conduit;

wherein the conduit comprises a plurality of retainers each connected to a section of the cable to support the conduit along its length; and wherein the conduit comprises a plurality of weights along a length of the conduit positioned substantially opposite the positions of the retainers whereby the weights act on the conduit to put pressure on the cable, to urge the conduit open along its length.

13. The method as described in claim 12 wherein the conduit comprises a plurality of floats along a length of the conduit positioned substantially aligned with the positions of the retainers whereby the floats act on the conduit against the weight of the weights to urge the conduit open along its length.

14. A method for utilising the current in a large body of water, including an ocean to raise water from a lower region of the body of water, containing colder more nutrient rich water, to an upper region of the body of water, containing warmer less nutrient rich water, comprising the steps of:

(a) submersing a conduit into the body of water, the conduit including a lower end having a lower opening and an upper end having an upper opening, such that the lower opening is in the lower region and the upper opening is in the upper region;

(b) anchoring the lower opening in place against movement by the current;

(c) maintaining the upper opening downstream from the lower opening so that the conduit is angled from the vertical in a direction downstream from the lower opening wherein the conduit is oriented in a direction with the current and the lower opening is oriented in a generally vertical plane wherein the maintaining is undertaken by utilising the current to maintain the upper opening downstream of the lower opening;

(d) utilizing the current to direct the water into the lower opening to flow upwards through the conduit and out the upper opening; and wherein the outer periphery of the upper opening defines a plane that is substantially vertical when the upper opening is maintained in the said position downstream from the lower opening.

15. The method as described in claim 14 wherein the outer peripheries of the lower and upper openings define respective planes that are substantially vertical when the upper opening is maintained in the said position downstream from the lower opening.

16. A method for utilising the current in a large body of water, including an ocean to raise water from a lower region of the body of water, containing colder more nutrient rich water, to an upper region of the body of water, containing warmer less nutrient rich water, comprising the steps of:

(a) submersing a conduit into the body of water, the conduit including a lower end having a lower opening and an upper end having an upper opening, such that the lower opening is in the lower region and the upper opening is in the upper region;

(b) anchoring the lower opening in place against movement by the current;

(c) maintaining the upper opening downstream from the lower opening so that the conduit is angled from the vertical in a direction downstream from the lower opening wherein the conduit is oriented in a direction with the current and the lower opening is oriented in a generally vertical plane wherein the maintaining is undertaken by utilising the current to maintain the upper opening downstream of the lower opening;

(d) utilizing the current to direct the water into the lower opening to flow upwards through the conduit and out the upper opening; and wherein the outer periphery of the lower opening defines a plane that is angled in respect of the side of the conduit by an angle between approximately 45 to 60 degrees.

17. A passive current deflector for raising water and embedded nutrients from a lower region of a large body of water, including an ocean, having a current, the deflector comprising:

(a) a conduit suitable for submersing into the body of water, the conduit including a lower end having a lower opening and an upper end having an upper opening;

(b) an anchor connected to the lower end for maintaining the lower opening in place against movement by the current;

(c) a float responsive to the current for maintaining the upper opening downstream from the lower opening so that in use: (i) the conduit is angled from the vertical in a direction downstream from the lower opening, (ii) the conduit is oriented in a direction with the current so that the lower opening is aligned with the current and, (iii) the lower opening is oriented in a generally vertical plane;

wherein, due to the position of the conduit in use, the current directs water into the lower opening causing it to flow upwards through the conduit and out the upper opening; and wherein the cross-sectional area of the lower opening is greater than the cross-sectional area of the upper opening.

18. The deflector as described in claim 17 further comprising a second anchor to assist in maintaining the upper opening in the said position.

19. The deflector as described in claim 17 wherein the cross-sectional area of the lower opening is between 1.5 to 2 times as large as the cross-sectional area of the upper opening.

20. The deflector as described in claim 17 wherein the lower opening is elliptical with a horizontal diameter of about 50 meters and the upper opening is circular with a diameter of about 30 meters.

21. The deflector as described in claim 17 further comprising a cable connecting the anchor to the lower end, the cable extending substantially along the length of the conduit to support the conduit when in use.

22. The deflector as described in claim 21 wherein the cable connects the float to the upper end.

23. The deflector as described in claim 17 wherein the outer periphery of one or both of the lower opening and upper opening define respective planes that are substantially vertical when in the said position.

24. The deflector as described in claim 17 further comprising vanes extending outwardly form the lower opening responsive to the current flow to urge the periphery of the opening outwardly to maintain the shape of the opening.

25. The deflector as described in claim 17 wherein the outer periphery of one or both of the lower opening and upper opening define respective planes that are angled in respect of the side of the conduit by an angle between approximately 45 to 60 degrees.

26. A passive current deflector for raising water and embedded nutrients from a lower region of a large body of water, including an ocean, having a current, the deflector comprising:

(a) a conduit suitable for submersing into the body of water, the conduit including a lower end having a lower opening and an upper end having an upper opening;

(b) an anchor connected to the lower end for maintaining the lower opening in place against movement by the current;

(c) a float responsive to the current for maintaining the upper opening downstream from the lower opening so that in use: (i) the conduit is angled from the vertical in a direction downstream from the lower opening, (ii) the conduit is oriented in a direction with the current so that the lower opening is aligned with the current and, (iii)

the lower opening defines a plane oriented generally perpendicular with the current;

(d) a cable connecting the anchor to the lower end, the cable extending substantially along the length of the conduit to support the conduit when in use, wherein the cable connects the float to the upper end;

wherein the conduit comprises a plurality of weights along a length of the conduit positioned substantially opposite the position of the cable, such that when in use the weights act on the conduit to put pressure on the cable, to urge the conduit open along its length; and wherein, due to the position of the conduit in use, the current directs water into the lower opening causing it to flow upwards through the conduit and out the upper opening.

27. The deflector as described in claim 26 wherein the conduit comprises a plurality of floats along a length of the conduit positioned substantially aligned with the cable whereby the floats act on the conduit against the weight of the weights to urge the conduit open along its length.

* * * * *

UNITED STATES PATENT AND TRADEMARK OFFICE

CERTIFICATE OF CORRECTION

PATENT NO. : 8,740,499 B2
APPLICATION NO. : 12/919207
DATED : June 3, 2014
INVENTOR(S) : Michael Wayne Heavenor It is certified that error appears in the above-identified patent and that said Letters Patent is hereby corrected as shown below:

In the Claims:

Column 7, line 59, “their” should read -- there --.

Column 10, line 44, “form” should read -- from --.

Signed and Sealed this
Twenty-second Day of December, 2015

Michelle K. Lee

Michelle K. Lee
*Director of the United States Patent and Trademark Office*